US005703428A

United States Patent [19]

Borgis

[11] Patent Number: 5,703,428

[45] Date of Patent: Dec. 30, 1997

[54] ELECTRIC MAINS VOLTAGE LAMP

[75] Inventor: Livio Borgis, S. Antonino di Susa, Italy

[73] Assignee: U.S. Philips Corporation, New York, N.Y.

[21] Appl. No.: 574,828

[22] Filed: Dec. 19, 1995

[30] Foreign Application Priority Data

Dec. 20, 1994 [EP] European Pat. Off. ..... 94203687
Jan. 27, 1995 [EP] European Pat. Off. ..... 95200200

[51] Int. Cl.[6] ..... H01J 5/54; H01R 4/50

[52] U.S. Cl. ..... 313/318.1; 313/318.05; 313/318.09; 313/318.1; 439/617

[58] Field of Search ..... 313/318.1, 318.01, 313/318.05, 318.03, 318.09, 318.11, 492, 113, 493, 580, 634; 439/411, 611, 699.1, 699.2, 612, 613, 615, 616, 619, 375, 617

[56] References Cited

U.S. PATENT DOCUMENTS

| | | | |
|---|---|---|---|
| 2,464,990 | 3/1949 | Plagge | 313/318.11 X |
| 2,965,875 | 12/1960 | Danesi | 439/419 |
| 3,116,885 | 1/1964 | Morse | 240/92 |
| 3,312,814 | 4/1967 | Reading | 240/46.57 |
| 3,435,203 | 3/1969 | Reading | 240/46.57 |
| 3,946,263 | 3/1976 | Protzeller | 313/312 |
| 4,201,438 | 5/1980 | Shea | 439/611 |
| 5,143,443 | 9/1992 | Madsen | 362/25 |
| 5,278,741 | 1/1994 | Ehrman | 439/619 X |
| 5,411,410 | 5/1995 | Ogawa et al. | 439/619 X |
| 5,439,389 | 8/1995 | Cheng et al. | 439/615 X |

FOREIGN PATENT DOCUMENTS 0970240 9/1964 United Kingdom .

*Primary Examiner*—Ashok Patel
*Attorney, Agent, or Firm*—Walter M. Egbert

[57] ABSTRACT

The electric mains voltage lamp has a lamp cap with a cylindrical portion abutting a glass envelope. A resilient cover member circumferentially clamps around and covers the cylindrical portion of the lamp cap and has a circumferential, outwardly extending, flexible collar. The cover member may also cover a cylindrical portion of the envelope which is adjacent the lamp cap. If the envelope is tubular in shape, the cover member may be a sleeve closed at an end thereof which is remote from the lamp cap, so as to cover the whole of the envelope. If the lamp has a bulbous envelope, the lamp may have a resilient domeshaped member covering a portion of the envelope opposite the lamp cap and having an overlap with the cover member. The lamp is able to provide a gastight connection to a lampholder.

17 Claims, 11 Drawing Sheets

ELECTRIC MAINS VOLTAGE LAMP

BACKGROUND OF THE INVENTION

The invention relates to an electric mains voltage lamp comprising:

- a sealed glass envelope having an axis;
- a lamp cap fixed to the envelope and surrounding the axis thereof, said lamp cap having contacts and a substantially cylindrical portion abutting the envelope;
- an electric element inside the envelope, from which current conductors extend to the contacts of the lamp cap;
- a resilient cover member circumferentially clamping around and covering at least a portion of the lamp.

The invention also relates to a lampholder for such a lamp.

Such a lamp is known from U.S. Pat. No. 5,143,435.

The known lamp is a reflector lamp in which the light-emission window portion of the envelope opposite to the lamp cap is covered by a rubber jacket which is coloured by an organic pigment in order to impart colour to the light emitted by the lamp during operation. The jacket is forced over the envelope and is kept in place by its own resilience. The lamp has a threaded lamp cap.

U.S. Pat. No. 3,312,814 and 3,435,203 disclose an electric lamp which has a colour filter body having internal ribs snapped over the domed portion of the envelope.

GB-B 970 240 and its corresponding U.S. Pat. No. 3,116,885 disclose an electric lamp in a lampholder, which lamp is enveloped by a silicone rubber light filter. The filter is retained in that a grooved edge thereof is snapped over a flange of the lampholder. Thus unintentional removal of the filter is counteracted.

For some applications of electric lamps it is desired that the contacts of the lamp cap are protected from moisture which could short-circuit the lamp. An electric lamp having a bayonet lamp cap is known from U.S. Pat. No. 3,946,263. Insulated wires are soldered to the contacts of its cap. The entire unit of the capped lamp and the insulated wires at and adjacent to their connection to the cap are covered with a silicone composition by e.g. dipping or spraying. A rubber boot is positioned on the wires at their connection to the cap. It is a disadvantage of this lamp that its replacement is cumbersome and that it cannot be mounted in a conventional lampholder.

German Utility Model J 548 (25-02-50) relates to a lampholder for an electric mains voltage lamp which comprises a housing having a main body which defines a lamp cavity having a lamp entrance, contact members for supplying mains voltage, an electric cable entering the housing opposite to the lamp entrance and electrically connected to the contact members, and a first annular sealing member and a pressure member for seating the housing around the electric cable by pressure exerted by the pressure member on the sealing member. When an electric lamp is mounted in the lampholder, the cavity can be sealed by screwing a nut onto a screwthread at the outside of the main body while interposing a resilient O-ring.

It is a disadvantage that the means for sealing the lampholder to the lamp are present in the lampholder, because upon exchanging a lamp the ring may get lost, or may be left out. Also, the ring may have lost its sealing properties during the life time of the lamp replaced. As a result, there is a risk that the lampholder is no longer properly sealed after replacement of a lamp.

It is another disadvantage of the known lampholder that the pressure member is a nut too, requiring also screwthread to be made at the housing. Furthermore, assembling of the lampholder is cumbersome, the more so as the contact members have to be inserted into the main body via the lamp entrance, which causes the electric cable to be slid through the holder, too.

SUMMARY OF THE INVENTION

It is an object of the invention to provide an electric lamp of the kind described in the opening paragraph which is of a construction capable of preventing ambient moisture from wetting its contacts when mounted in a lampholder, while the lamp can nevertheless be easily replaced.

It is another object of the invention to provide a lampholder for such an electric lamp which is sealed when the lamp is mounted therein and is of a construction which is simple and can be simply realised.

The first object is achieved in that the cover member clamps around and covers the cylindrical portion of the lamp cap, leaving bare the contacts thereof, and has a circumferential, outwardly extending flexible collar.

The flexible collar adapts its dimensions to the lampholder into which the lamp is mounted, thereby sealing the passage between the lamp cap and the lampholder which would otherwise be present. For ease of insertion into a lampholder, it is favourable if the collar has a conical surface facing away from the envelope. The collar may be tapering away from the lamp cap if a large flexibility is required.

In a favourable embodiment the cover has a second circumferential flexible collar axially spaced apart from the first collar. This provides additional certainty that moisture will not penetrate into the lampholder.

If desired, the cover member may have an internally narrowed end portion which rests against a surface portion of the lamp cap facing away from the envelope. It is prevented thereby that the cover member could be rolled up when the lamp is inserted into a relatively narrow lampholder.

Generally, the lamp cap is secured to the envelope is such a manner, e.g. by means of an adhesive, e.g. by cement, that moisture is prevented from penetrating into the lamp cap between the envelope and the rim of the cap. If it is desirable to intentionally obviate such penetration, it is favourable if the cover member also circumferentially clamps around and covers a substantially cylindrical portion of the envelope which is adjacent the lamp cap. Any clearance between the cap and the envelope is sealed up then.

Occasionally, electric lamps are used in environments in which there is a risk of explosions, e.g. in refrigerators in which the coolant liquid is a volatile hydrocarbon. It is then necessary to prevent an electric arc occurring in a space in which combustible vapour is present, e.g. as a result of leakage. Such an arc might occur within the lampholder or within the lamp cap, but also within the envelope when the lamp is switched on after the envelope has fractured. In a favourable embodiment of the lamp of the invention, this risk is obviated in that the envelope is substantially tubular in shape and the cover member is a sleeve closed at an end thereof which is remote from the lamp cap, so as to cover the whole of the envelope.

In another embodiment in which the envelope has a bulbous shape and a largest diameter transverse to the axis in an area remote from the lamp cap, a resilient dome shaped member covers a portion of the envelope opposite the lamp cap including the area of the largest diameter, and has an overlap with the cover member. Generally, in the case of lamps having a bulbous envelope it will not be possible to slip the relatively narrow portion of the cover which fits the cylindrical portion of the lamp cap over the widest portion of the envelope, as this portion generally has a diameter which is more than twice the diameter of said portion of the cap. An overlapping arrangement of the cover and the dome shaped member provides for security against explosions.

A positive retention of the cover and the dome shaped member in their overlapping arrangement is present in a variation of this embodiment in which the dome shaped member and the cover member have in the overlap a circumferential interlocking structure. This structure may comprise e.g. a ridge cooperating with a groove, or several ridges and grooves, or one or more ridges interlocking with two or more ridges. A ridge may e.g. in cross-section be shaped as an arrow, which may snap into a groove of complementary shape. Such an interlocking structure may also ameliorate the adhesion of the two bodies concerned should the envelope have collapsed, and also ensure the gas-tightness of the overlap in such an event.

The envelope may favourably have a light-reflecting coating in the area between the largest diameter and the lamp cap. The dome shaped member may then be light-diffusing in order to prevent an image of the electric element being formed by the reflecting coating. In most lamps having such a reflecting coating, the envelope itself is made light-diffusing to that end, e.g. by etching of the glass with hydrofluoric acid. This implies not only an extra step in the manufacture of the lamp and the use of a chemical producing reactants which are noxious to the environment, but also results in a frosted surface of the envelope in the area which is to be made light-reflecting. As a result, light is dispersed as well as reflected and the lightbeam created is broadened. The dome-shaped member may be light-diffusing as a result of having a rough surface, e.g. a rough inner surface, or by having a powder, e.g. quartz powder, finely dispersed therein. The dome-shaped member may contain a colouring agent.

In a favourable embodiment, the contacts of the lamp cap are members axially extending therefrom, such as e.g. pins or strips. A lamp having a lamp cap with such contact members is known from U.S. Pat. No. 5,313,134. The lamp according to the invention having a cap with such contact members, has the advantage of allowing a fast replacement. This is particularly important if a large number of lamps has to be replaced at a time, e.g. reflector lamps of the kind described used in a display panel, such as e.g. a score-board.

The electric element may be an incandescent body, for instance in a halogen-containing gas, or a pair of electrodes in an ionisable medium, possibly in a sealed inner envelope.

The electric lamp of the invention can be used e.g. in a lampholder of the type described in the cited German Utility Model J 548. The nut and the resilient O-ring for sealing the entrance to the cavity of the holder are superfluous then, the lamp supplying its own means for that purpose. These means are replaced thus automatically each time the lamp is replaced. Alternatively, the lamp may be used in a similar lampholder, which is, however, not sealed about a cable, if the lampholder is itself accommodated in a separate chamber and its lamp entrance only is located in surroundings which are moist or in which there is an explosion risk.

According to the invention, in a lampholder of the kind referred to above, the second object of the invention is achieved in that the main body has a channel for each contact member, open to the lamp cavity, in which channels the contact members are held and into which the contact members, which are connected to the cable, are introduced from an end of the main body which is remote from the lamp entrance along a substantially rectilinear path, and the pressure member is assembled with the housing in a substantially rectilinear movement and is permanently secured thereto.

The lampholder of the invention is of a simple construction and can be simply realised. As the contact members can be inserted from the rear, the cable need not to be threaded through the housing. The substantially rectilinear movements in mounting the contact members and in assembling the pressure member also contribute to an easy and fast assembling. The permanent fastening of the pressure member to the housing contributes to the reliability of the holder, as the annular sealing member cannot be erroneously left out by a user, which would be possible if the lampholder were dismountable.

The housing may have means, e.g. a flange, for fixing the holder to a wall or in an opening in a wall. In a special embodiment, the housing of the lampholder has an intermediate body in between the main body and the pressure member, the intermediate body and the main body being assembled in a substantially rectilinear movement and being permanently secured, and being sealed one to another by the interposition of a second annular sealing member.

An advantage of the intermediate body is that in assembling the lampholder it allows for an easy change-over to another one of a number of means to fix the lampholder to a wall. Thus, the intermediate body may comprise a flange, e.g. a flange having holes for e.g. screws, or a twin-flange defining slots and enabling the mounting of the lampholder in an opening in a wall e.g. in a bayonet-type movement. Alternatively, the intermediate body has resiliently mounted barbed hooks for being slid through an opening in a wall and snapping behind that wall.

Also, the intermediate body is an easy means to bridge a relatively large difference in the diameter of a cable and the mutual distance of the contact members, as will become apparent from the drawings.

It is convenient if the channels in the main body have resilient means allowing the contact members to pass when they are mounted, and snapping behind them after they have passed, so as to block their return.

The contact members may be designed to contact pin-shaped contacts of an electric lamp, e.g. in that they are C-shaped in cross-section in order to receive such contacts with clamping action. Alternatively, however, bayonet-capped lamps or Edison-capped lamps may be mounted in the lampholder. To that end, contact means may be mounted in the lamp cavity which are secured to the contact members e.g. by means of a pin-shaped or tongue-shaped protrusion thereof, which is held with clamping force by the e.g. C-shaped contact members. Such contact means may be excentric plates positioned on a bottom wall of the lamp cavity to contact a bayonet cap, or a central plate and a threaded ring to contact an Edison cap.

The pressure member and the housing, and also the main body and the intermediate body, if present, can easily be secured by means of bores and cooperating, slightly oversized pins. After the pins have been forced into respective bores, which may be done for all parts in one step e.g. by using a press, the lampholder is permanently mounted. In addition, pins of one member or body penetrating another may be deformed e.g. ultrasonically or by a heated tool. This may also occur if the pins are not oversized. An alternative is e.g. the use of rivets.

BRIEF DESCRIPTION OF THE DRAWINGS

Embodiments a the electric lamp and the lampholder according to the invention are shown in the drawings, in which.

DESCRIPTION OF THE PREFERRED EMBODIMENTS

Figure 1:
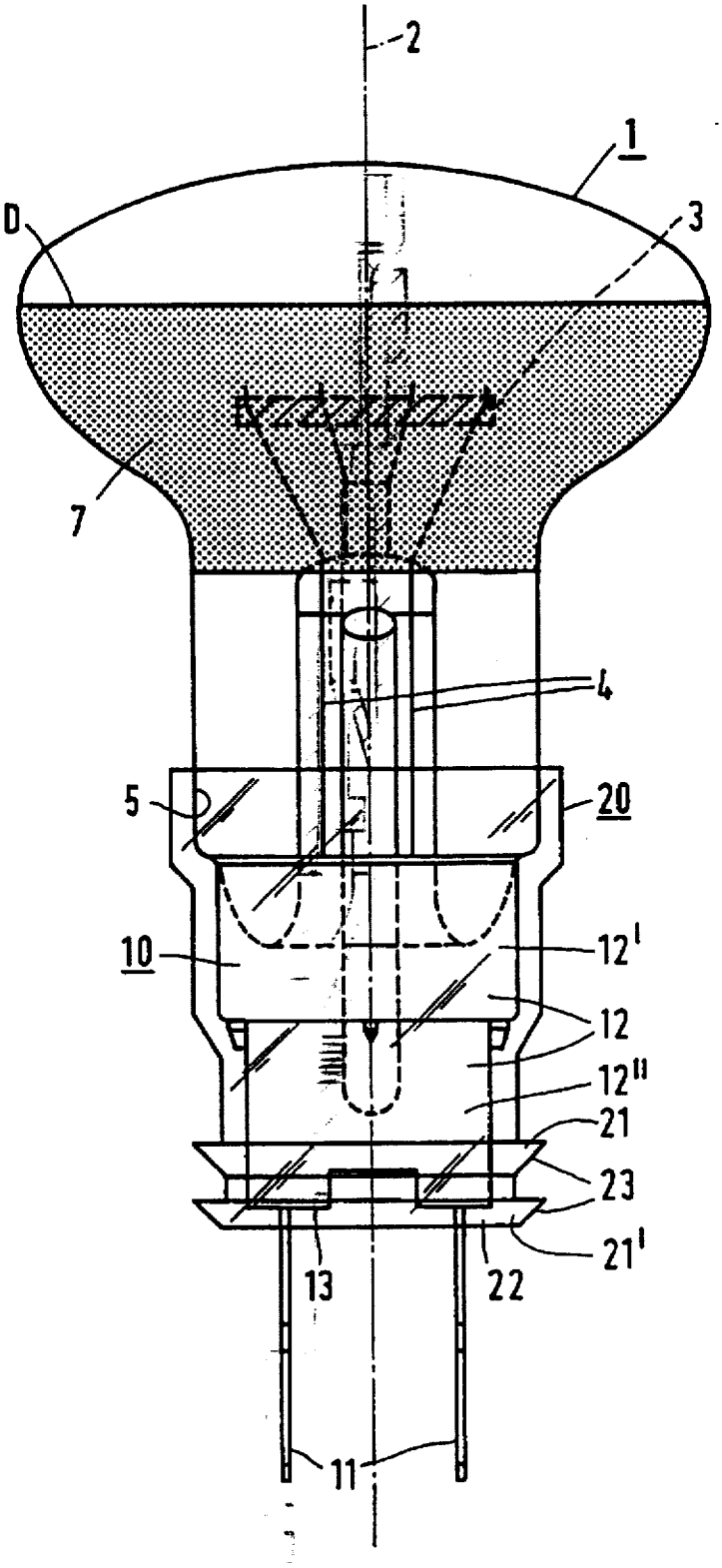
FIG. 1 represents a first embodiment in side elevation.

In FIG. 1 the electric mains voltage lamp comprises a sealed, blown glass envelope 1 which has an axis 2. A lamp cap 10 is fixed to the envelope, e.g. by means of cement, and surrounds the axis thereof. The lamp cap has contacts 11 and a substantially cylindrical portion 12 which abuts the envelope. The cylindrical portion 12 has, in the cap shown, a relatively wide pan 12', in the figure of metal, and a relatively narrow pan 12", in the figure of synthetic resin. In the figure, the contacts extend away from the lamp cap in axial direction. They are strip-shaped. An electric element 3, in the figure an incandescent body, is accommodated inside the envelope, connected to current conductors 4 which extend to the contacts of the lamp cap. A resilient cover member 20 circumferentially clamps around and covers at least a portion of the lamp. The envelope 1 shown is bulbous in shape and has a largest diameter D transverse to its axis 2. In an area between the largest diameter D and the lamp cap 10, the envelope 1 has a light-reflecting coating 7, e.g. obtained by depositing a metal such as aluminium or silver.

The cover member 20, e.g. of silicone rubber or of butylene rubber, clamps around and covers the cylindrical portion 12 of the lamp cap 10, leaving bare the contacts 11 thereof, and has a circumferential, outwardly extending flexible collar 21.

The cover member 20 also circumferentially clamps around and covers a substantially cylindrical portion 5 of the envelope 1 which is adjacent the lamp cap 10 and thereby positively closes any passage between the envelope 1 and the cap 10.

The cover 20 has a second circumferential flexible collar 21' axially spaced apart from the first collar 21. In the figure, each of the collars 21, 21' has a conical surface 23 which faces away from the envelope 1. The collars taper away from the lamp cap 10 so that they have a large flexibility. The cover provides for an excellent prevention of moisture, vapours or gases penetrating to the contacts of the lamp cap after insertion into a lampholder.

Figure 2:
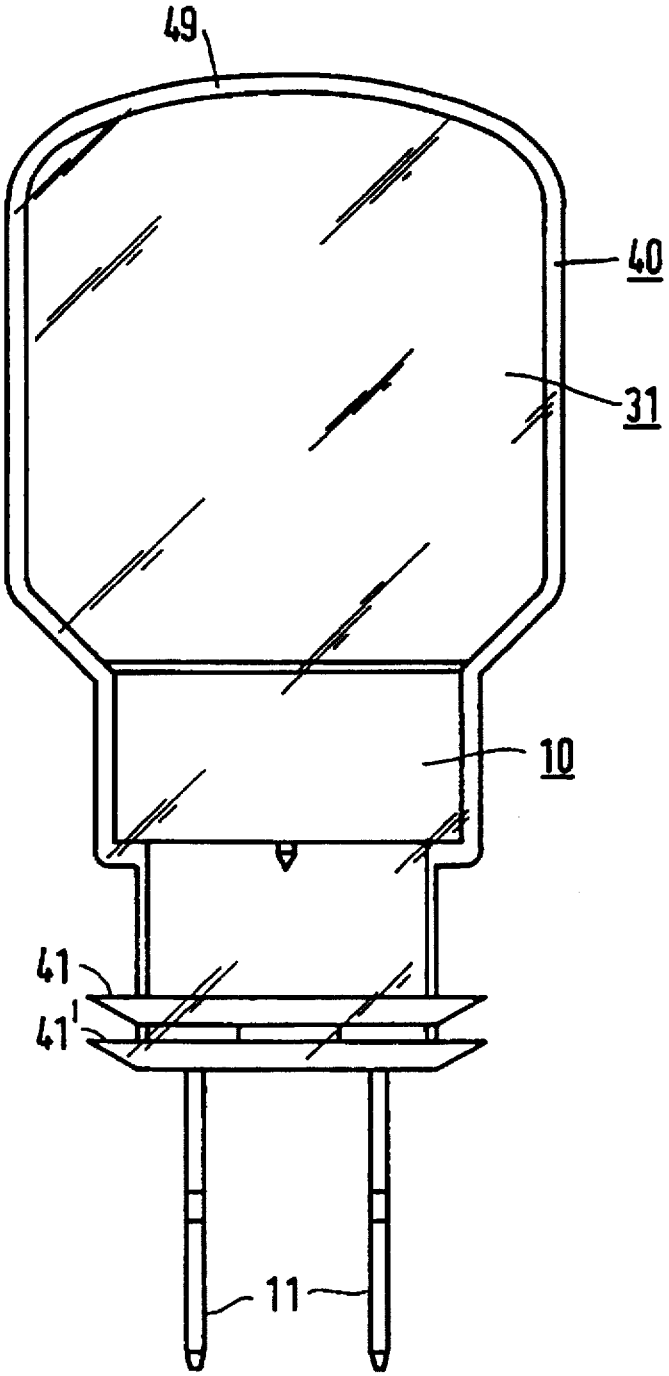
FIG. 2 a second embodiment in side elevation.

In FIG. 2, the envelope 31 is substantially tubular in shape and the cover member 40 (see also FIG. 4) is a sleeve closed at an end 49 thereof which is remote from the lamp cap 10, so as to cover the whole of the envelope 31. In the embodiment shown, the lamp cap 10 is identical to the one of FIG. 1 and the envelope 31 is frosted so that the incandescent body inside cannot be seen. The cover member 40 has two collars 41,41', as in FIG. 1. Except at its free end where the contact members 11 emerge, the cover member 40 envelops the lamp in a gas-tight manner. When inserted in a lampholder, the cover member 40 screens the contact members and the contacts of the lampholder with which they cooperate from gases surrounding the lamp. Even if the envelope is fractured, an arc occurring in the space sealed by the cover member, e.g. when power is applied to the lamp, is not accessible to such gases.

Figure 3:
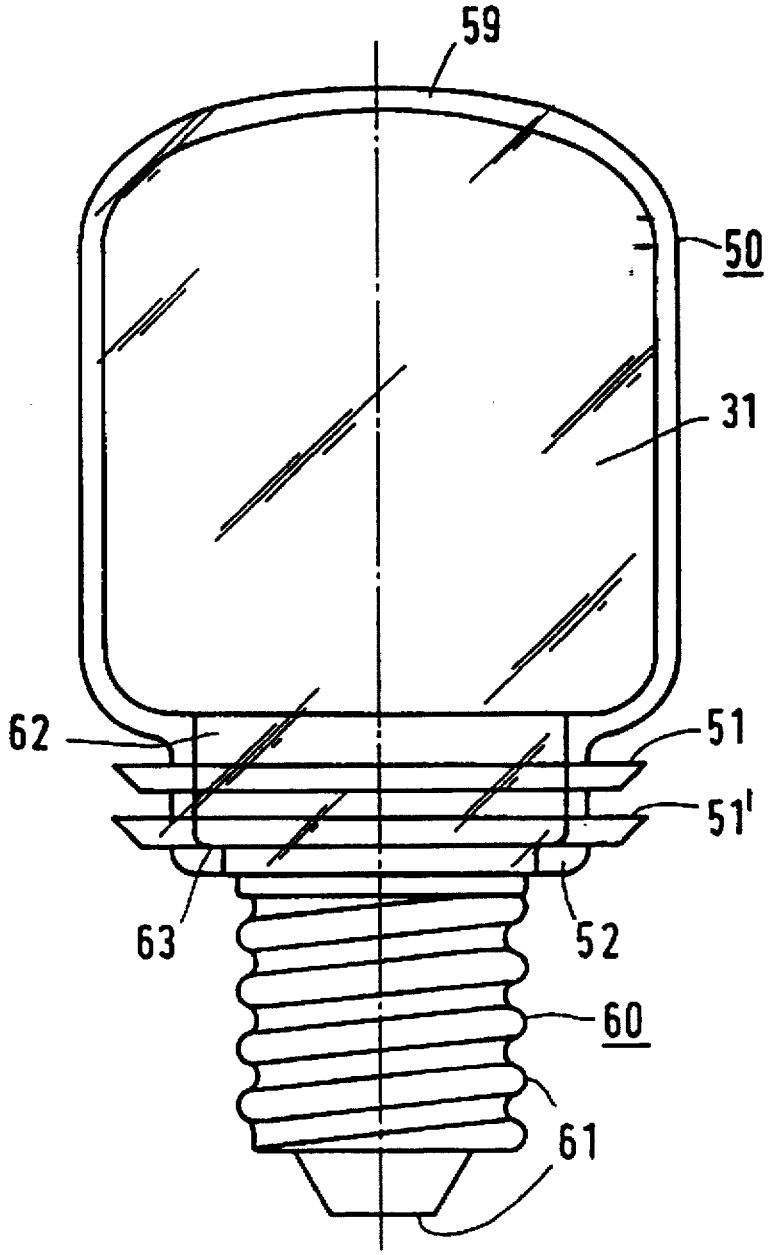
FIG. 3 a third embodiment in side elevation.

In FIG. 3, the envelope 31 is identical to the one of FIG. 2. A screw cap 60 is mounted to the envelope. A cover member 50, which envelopes the whole of the envelope 31 of the lamp, in a region where it has circumferential, outwardly extending collars 51,51' clamps around and covers the cylindrical portion 62 of the lamp cap 60. It has an internally narrowed end portion 52 which rests against a surface portion 63 of the lamp cap 60 facing away from the envelope 31.

Figure 4:
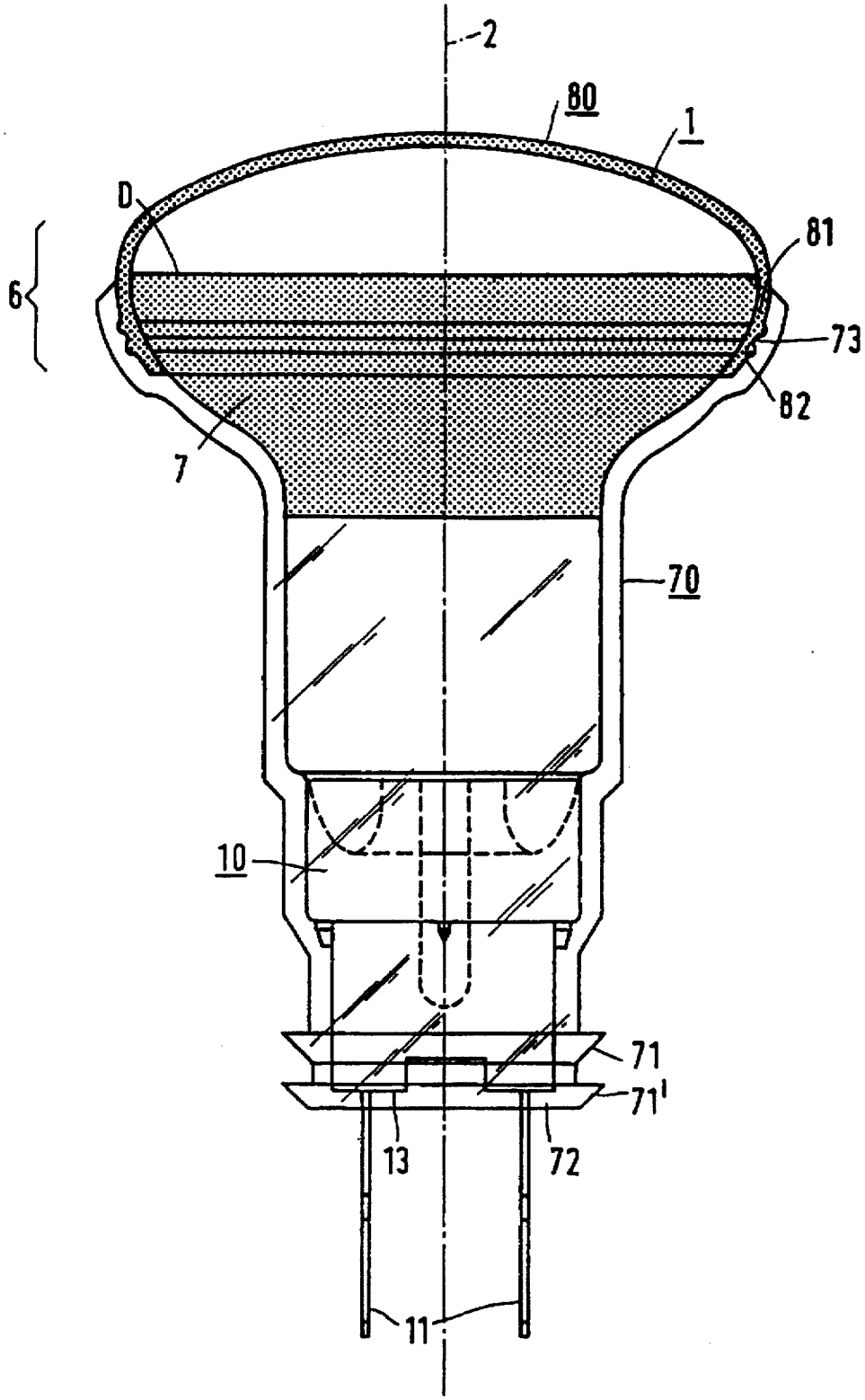
FIG. 4 a fourth embodiment in side elevation.
Figure 5:
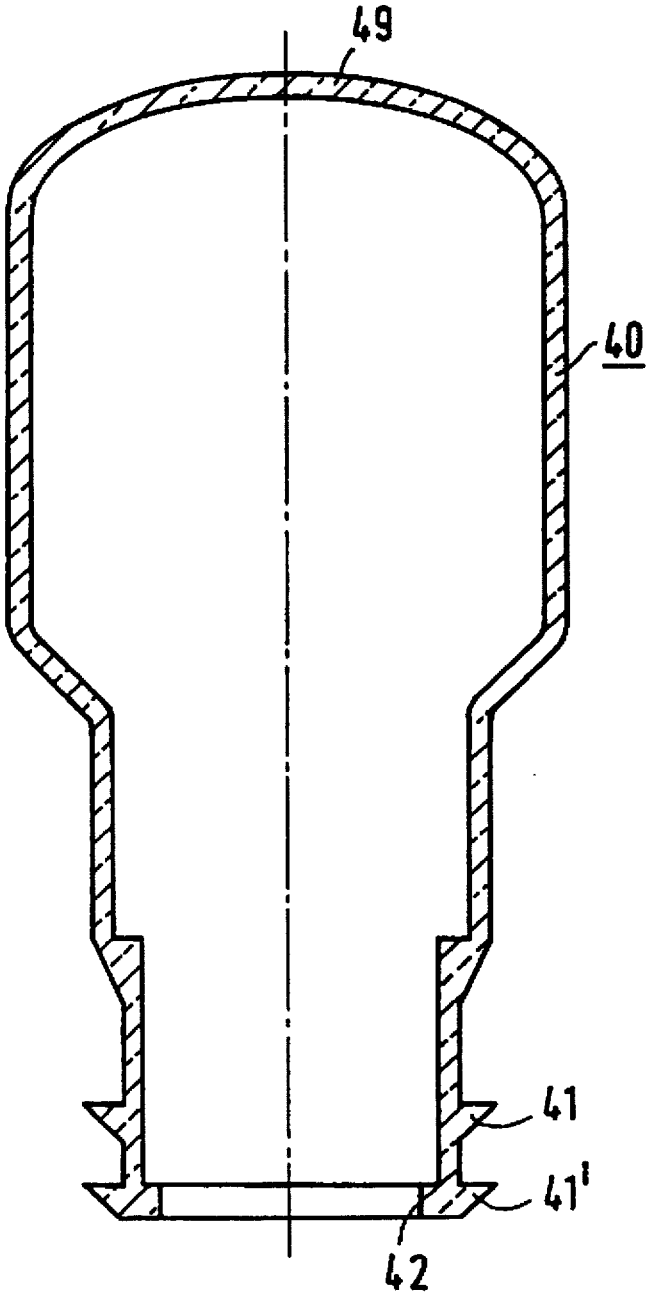
FIG. 5 a cover member for use in the lamp of FIG. 2 in axial section, prior to being mounted.

In FIG. 4, the electric lamp has the envelope 1 of FIG. 1 having a bulbous shape and a largest diameter D transverse to the axis 2 in an area 6 remote from the lamp cap 10. A resilient dome shaped member 80 covers a portion of the envelope 1 opposite the lamp cap 10 including the area 6 of the largest diameter D. The dome shaped member, e.g. of silicone rubber, has an overlap 81 with the cover member 70, in the figure in the area 6 of the largest diameter D. These members 78,80 in the figure have in the overlap 81 a circumferential interlocking structure, in the figure comprising a ridge 73 cooperating with a groove 82. In the figure, the dome shaped member 80 is light-diffusing. In addition, it contains a colouring agent dissolved therein.

The cover member 70 has an internally narrowed end portion 72 which rests against a surface portion 13 of the lamp cap 10 facing away from the envelope 1.

Figure 6:
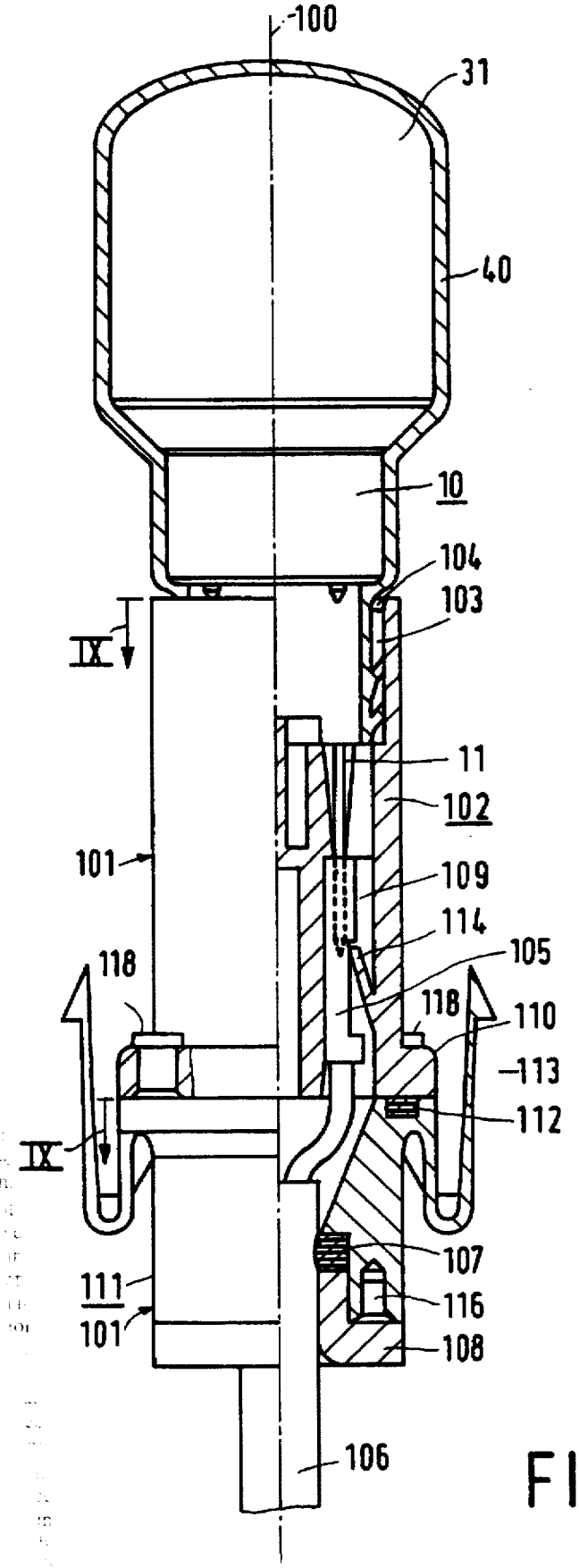
FIG. 6 a first embodiment of the lampholder, partly in side elevation, partly in sectional view.

In FIG. 6, the lampholder for an electric mains voltage lamp has a housing 101 which has a main body 102. The main body defines a lamp cavity 103 having a lamp entrance 104. Contact members 105 are present for supplying mains voltage to the contacts 11 of a lamp cap 10 of a lamp having an envelope 31 and a cover member 40 mounted in the lampholder. In FIG. 6, the lamp shown is the lamp of FIG. 2. The contact members hold the contacts 11 of the lamp with clamping force. An electric cable 106 enters the lampholder opposite to the lamp entrance 104 and is electrically connected to the contact members 105. A first annular sealing member 107, e.g. of silicone rubber, and a pressure member 108 are present to seal the housing 101 around the electric cable 106 through pressure exerted by the pressure member on the sealing member. In the figure, the housing 101 and the pressure member 108 are made from polybutylene terephthalate, but alternatively another, e.g. thermoplastic, resin may be used.

The main body 102 has a channel 109 for each contact member 105, open to the lamp cavity 103, in which channels the contact members are held and into which the contact members connected to the cable 106 are introduced from an end 110 of the main body which is remote from the lamp entrance 104 along a substantially rectilinear path. The pressure member 108 is assembled with the housing 101 in a substantially rectilinear movement and is permanently secured thereto.

It is seen that the contact member shown extends further remote from the centreline 100 of the holder than half the diameter of the cable 106. This would cause the need for a relatively wide first sealing member 107. In the figure, however, the housing 101 of the lampholder has an intermediate body 111, in between the main body 102 and the pressure member 108. The intermediate body 111 and the main body 102 are assembled in a substantially rectilinear movement and are permanently secured. They are sealed one to another by the interposition of a second annular sealing member 112.

On assembling the lampholder shown, the contact members 105, having connected thereto cable 106, are slid from the still open end 110 rectilinearly each into a respective channel 109 of the main body 102. The channels 109 have resilient means 114, in the figure tags which are integral with the main body, which allow the contact members 105 to pass and which snap behind them after they have passed, so as to block their return. Then the intermediate body 111 is positioned with respect to the main body 102, the second annular member 112 being present, and is mounted. Subsequently, the pressure member 108 and the first annular sealing member 107 are positioned and mounted. The intermediate body 111 could be assembled with the main body after the pressure member had been mounted. However, considerable frictional forces would then have to be overcome. Favourably, the intermediate body and the pressure member are assembled with the main body in the presence of the annular sealing members in one assembling step.

The intermediate body 111 is provided with means 113 to fix the lampholder to a wall. In the figure, these means are resiliently mounted barbed hooks which can slide through an opening in a wall when the lampholder is pushed through that opening, the lamp entrance 104 ahead. After having passed the wall, when the relatively wide end 110 of the main body 102 abuts the wall, the hooks spring back towards their original positions, hooking behind the wall and keeping the lampholder fixed.

Figure 14:
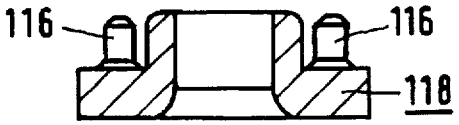
FIG. 14 a cross-section of the pressure member of FIG. 6, 7, 8.

The housing 101 and the pressure member 108 [see also FIG. 14] are secured by bores 115 (compare FIG. 12,13) and associated pins 116. The pins 116 are oversized with respect to the bores 115, so that they are frictionally held by the bores.

Figure 9:
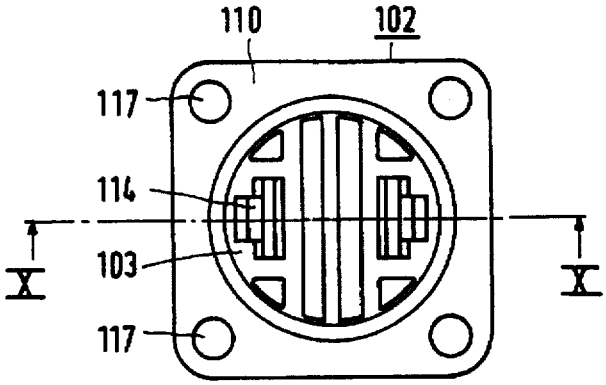
FIG. 9 a view of the main body according to IX in FIG. 6.
Figure 10:
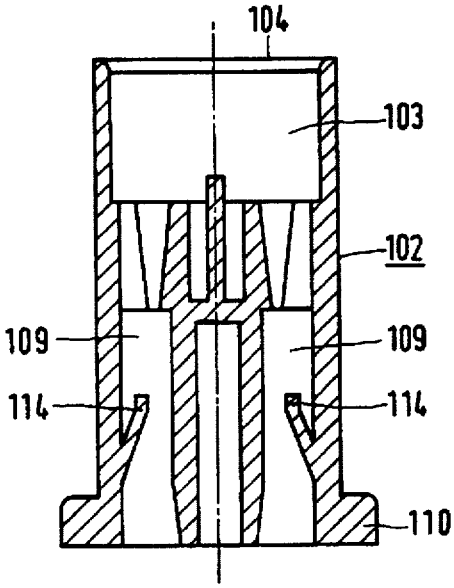
FIG. 10 a longitudinal cross-section according to X—X in FIG. 9.

The main body 102 (see also FIG. 9) and the intermediate body 111 (compare also FIG. 11, 12) are also secured by means of bores 117 and pins 118. The pins penetrate the bores and are plastically deformed, e.g. ultrasonically.

Figure 7:
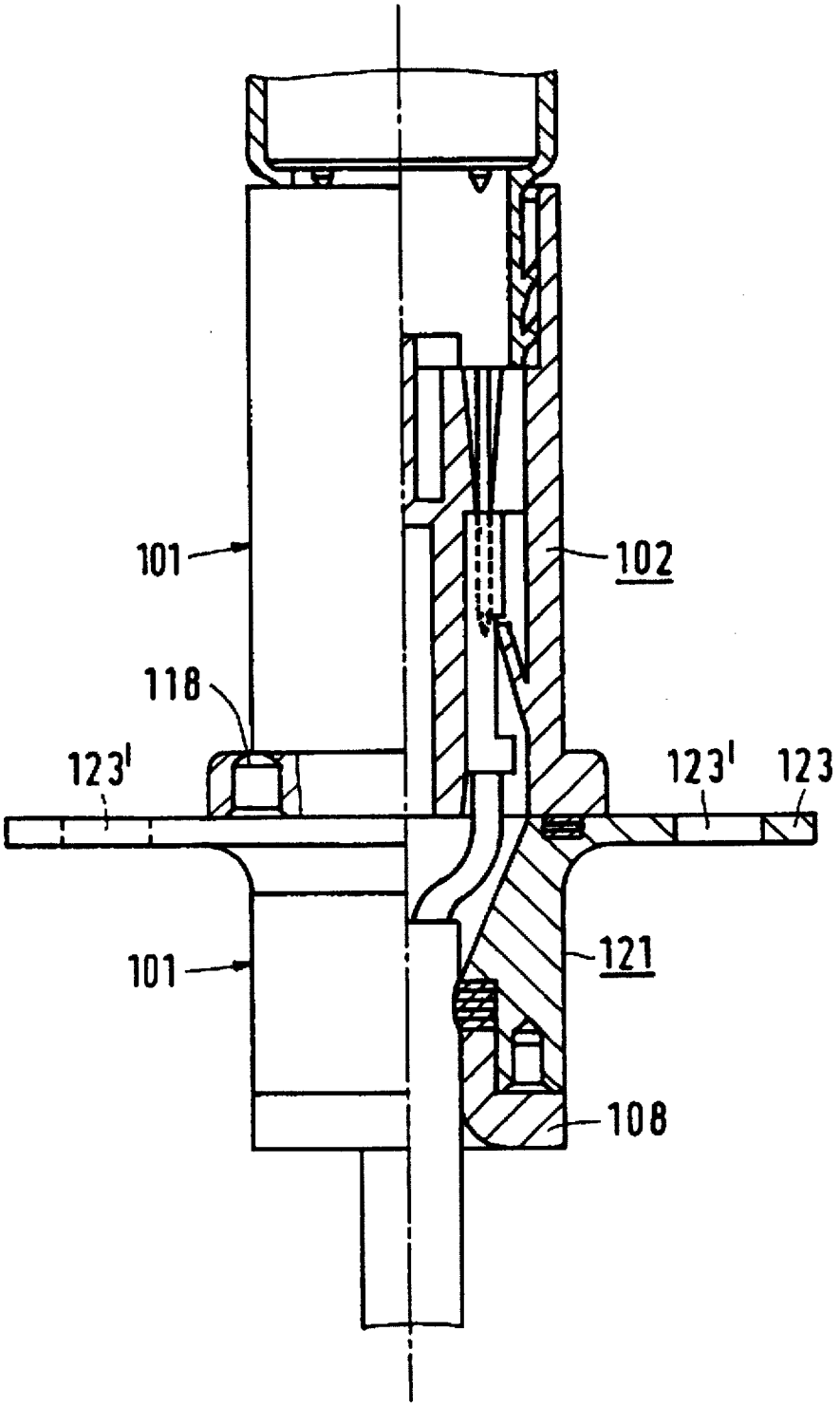
FIG. 7 a second embodiment of the lampholder is a similar presentation.

The lampholder of FIG. 7 is identical to the one of FIG. 6 except in that the means to fix the holder to a wall consist of a flange 123 having bores 123', present at the intermediate body 121. Moreover, the pins 118 securing the intermediate body to the main body do not emerge from the main body.

Figure 8:
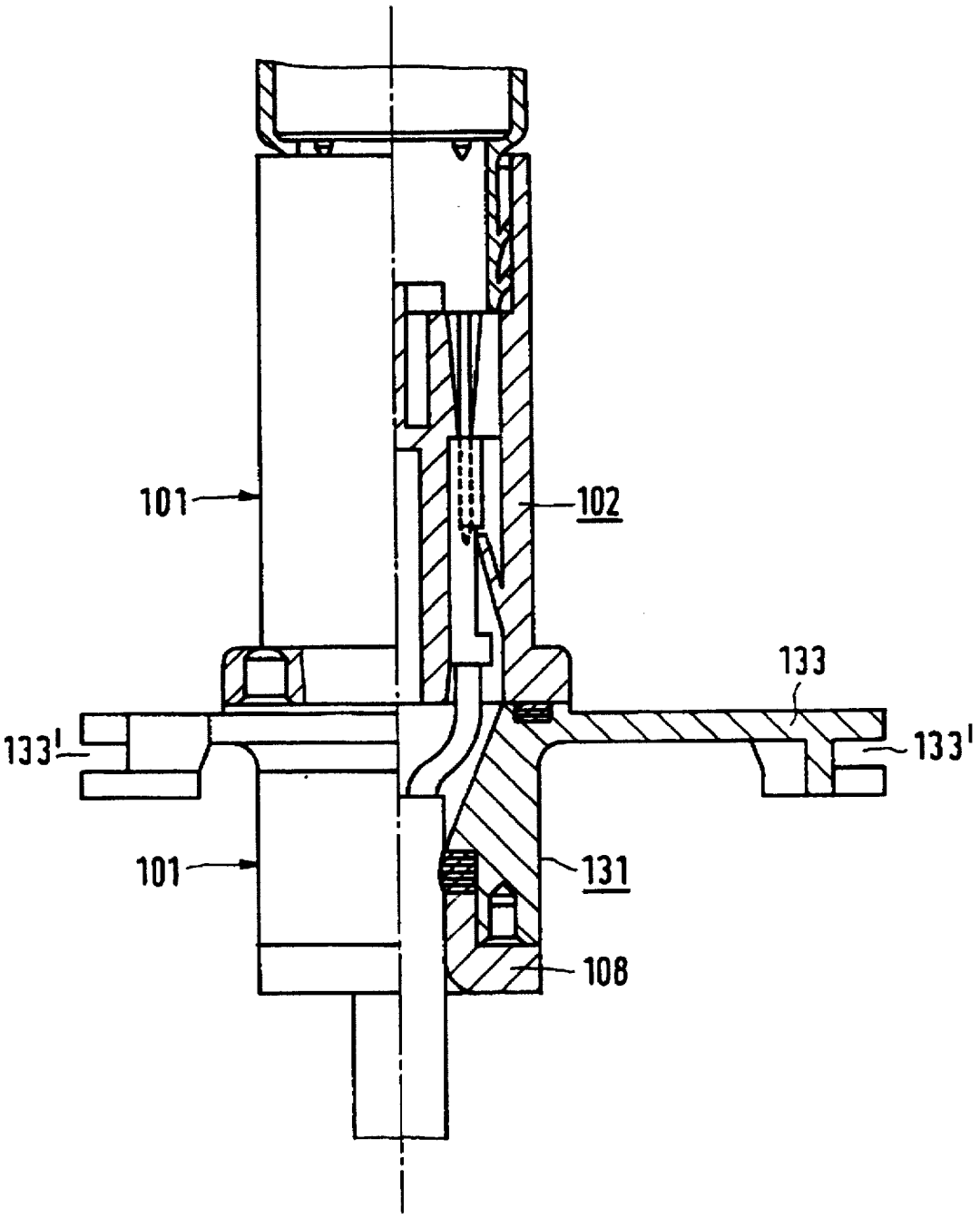
FIG. 8 a third embodiment of the lampholder in a similar presentation.

In FIG. 8 the intermediate body 131 has a twin flange 133 defining a slot 133' for securing the holder to a wall.

Figure 11:
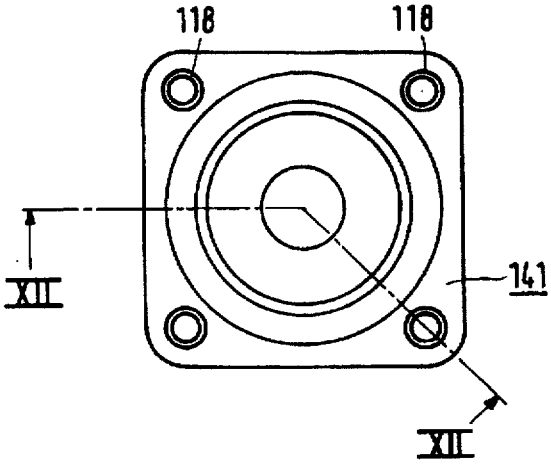
FIG. 11 a view according to XI in FIG. 6 of another embodiment of an intermediate body.
Figure 12:
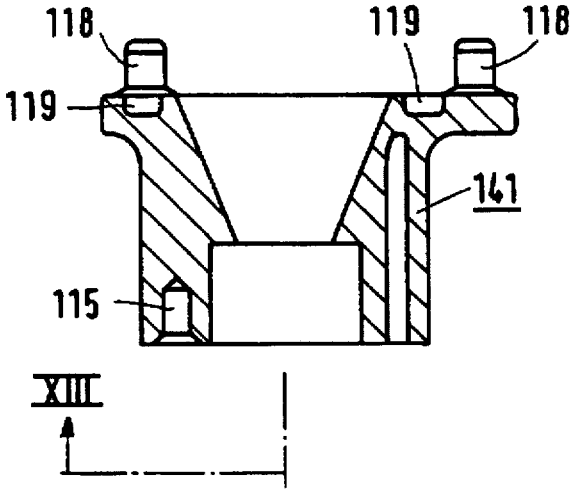
FIG. 12 a longitudinal cross-section according to XII—XII in FIG. 11.
Figure 13:
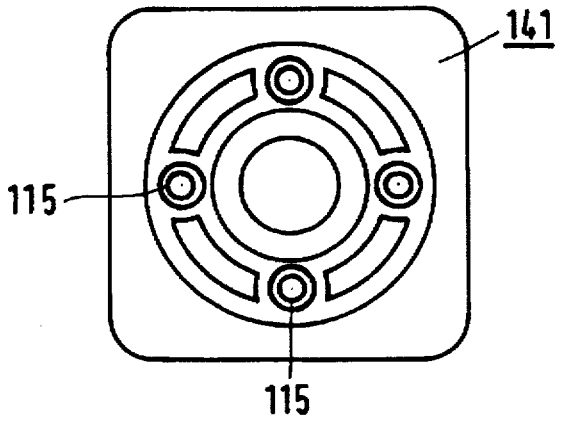
FIG. 13 a view according to XIII in FIG. 12.

The intermediate body 141 of FIGS. 11, 12, 13 has an annular recess 119 for accommodating a second annular sealing member (112 in FIG. 6). This body has no special means for mounting a lampholder comprising this body. Such a lampholder may be held by e.g. a clamping band.

Figure 15:
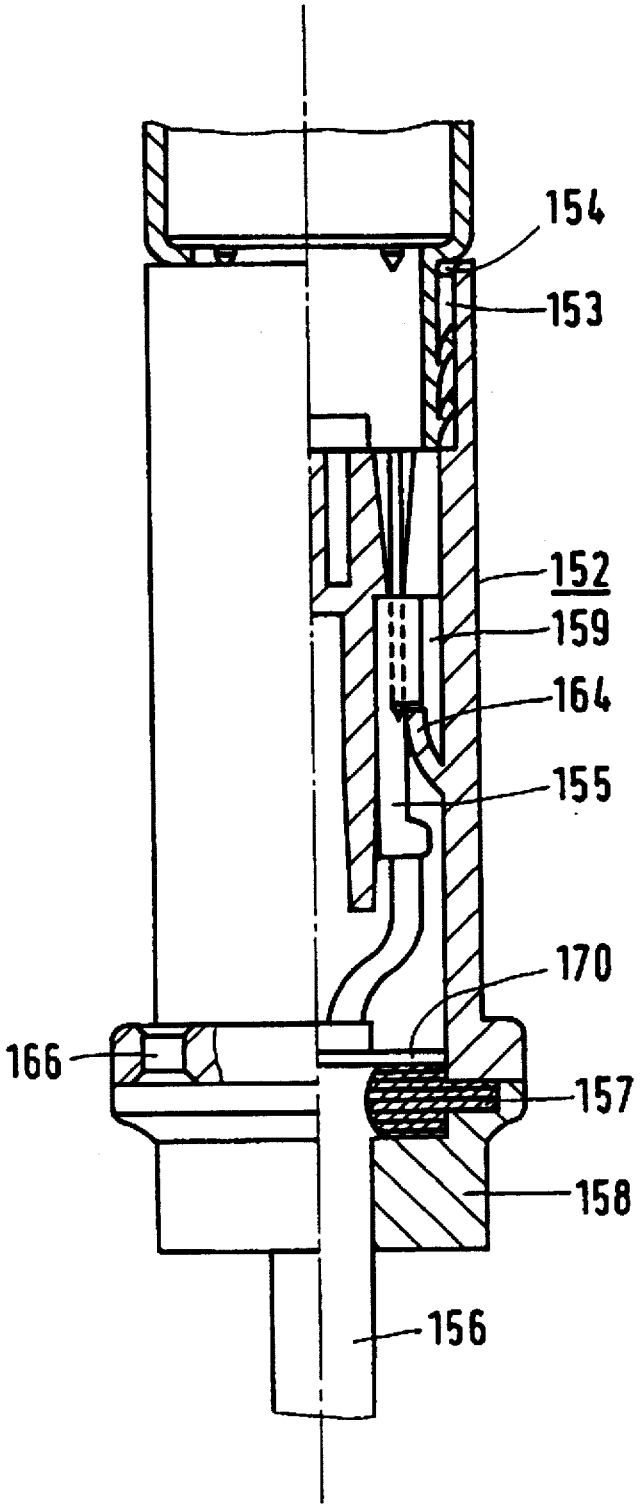
FIG. 15 a fourth embodiment of the lampholder in a similar presentation as in FIG. 6.

The embodiment of FIG. 15, in which the reference numerals are 50 higher than those of corresponding parts and portions in FIG. 6, has a unitary housing consisting of main body 152. The contact members 155 are introduced into the main body along a substantially rectilinear path. The first annular sealing member 157 bridges the relatively large difference between the diameter of cable 156 and the inner diameter of the main body 152. A disk 170, of e.g. hard plastic or of metal, which has a central bore to allow the cable 156 to pass, supports the annular member at the area of the entrance to the channels 159.

I claim:

1. An electric mains voltage lamp comprising:

a sealed glass envelope having an axis;

a lamp cap fixed to the envelope and surrounding the axis thereof, said lamp cap having contacts and a substantially cylindrical portion abutting the envelope;

an electric element inside the envelope, from which current conductors extend to the contacts of the lamp cap;

a resilient cover member circumferentially clamping around and covering at least a portion of the lamp, characterized in that: the cover member clamps around and covers the cylindrical portion of the lamp cap, leaving bare the contacts thereof, and has a first circumferential, outwardly extending flexible collar.

2. An electric lamp as claimed in claim 1, characterized in that the cover member circumferentially clamps around and covers a substantially cylindrical portion of the envelope which is adjacent the lamp cap.

3. An electric lamp as claimed in claim 2, characterized in that the envelope is substantially tubular in shape and the cover member is a sleeve closed at an end thereof which is remote from the lamp cap, so as to cover the whole of the envelope.

4. An electric lamp as claimed in claim 2, characterized in that the envelope has a bulbous shape and a largest diameter D transverse to the axis in an area remote from the lamp cap, a resilient dome shaped member covering a portion of the envelope opposite the lamp cap including the area of the largest diameter and having an overlap with the cover member.

5. An electric lamp as claimed in claim 4, characterized in that the dome shaped member and the cover member have a circumferential interlocking structure in the overlap.

6. An electric lamp as claimed in claim 5, characterized in that the interlocking structure comprises a ridge cooperating with a groove.

7. An electric lamp as claimed in claim 4, characterized in that the envelope has a light-reflecting coating in an area between the largest diameter D and the lamp cap.

8. An electric lamp as claimed in claim 7, characterized in that the dome shaped member is light-diffusing.

9. An electric lamp as claimed in claim 8, characterized in that the dome shaped member contains a colouring agent.

10. An electric lamp as claimed in claim 4, characterized in that the contacts of the lamp cap are members axially extending away from the lamp cap.

11. An electric lamp as claimed in claim 4, characterized in that the cover member has a second circumferential flexible collar axially spaced apart from the first collar.

12. An electric lamp as claimed in claim 3, characterized in that the cover member has an internally narrowed end portion which rests against a surface portion of the lamp cap facing away from the envelope.

13. An electric lamp as claimed in claim 7, characterized in that the dome shaped member contains a coloring agent.

14. An electric lamp as claimed in claim 2, characterized in that the cover member has an internally narrowed end portion which rests against a surface portion of the lamp cap facing away from the envelope.

15. An electric lamp as claimed in claim 1, characterized in that the contacts of the lamp cap are members axially extending away from the lamp cap.

16. An electric lamp as claimed in claim 1, characterized in that the cover member has a second circumferential flexible collar axially spaced apart from the first collar.

17. An electric lamp as claimed in claim 1, characterized in that the cover member has an internally narrowed end portion which rests against a surface portion of the lamp cap facing away from the envelope.

* * * * *